United States Patent [19]

Naito et al.

[11] Patent Number: 4,560,644

[45] **Date of Patent: * Dec. 24, 1985**

[54] HEAT-DEVELOPABLE LIGHT-SENSITIVE MATERIALS WITH SHIFTED DYES

[75] Inventors: Hideki Naito; Kozo Sato, both of Kanagawa, Japan

[73] Assignee: Fuji Photo Film Co. Ltd., Japan

[ * ] Notice: The portion of the term of this patent subsequent to Sep. 25, 2001 has been disclaimed.

[21] Appl. No.: 594,491

[22] Filed: Mar. 29, 1984

[30] Foreign Application Priority Data

Mar. 29, 1983 [JP] Japan ..... 58-51656

[51] Int. Cl.[4] ..... G03C 1/40

[52] U.S. Cl. ..... 430/351; 430/203; 430/218; 430/223; 430/559

[58] Field of Search ..... 430/203, 223, 559, 351, 430/617, 619, 218

[56] References Cited

U.S. PATENT DOCUMENTS

| | | | |
|---|---|---|---|
| 3,336,287 | 8/1967 | Idelson et al. | 430/225 |
| 3,880,658 | 4/1975 | Lestina et al. | 430/223 |
| 4,234,672 | 11/1980 | Ford et al. | 430/223 |
| 4,310,612 | 1/1982 | Mooberry et al. | 430/223 |
| 4,463,079 | 7/1984 | Naito et al. | 430/223 |
| 4,473,631 | 9/1984 | Hirai et al. | 430/203 |

FOREIGN PATENT DOCUMENTS

| | | | |
|---|---|---|---|
| 0076492 | 4/1983 | European Pat. Off. | 430/223 |
| 2729823 | 5/1978 | Fed. Rep. of Germany | 430/223 |
| 2058383 | 4/1981 | United Kingdom | 430/203 |

OTHER PUBLICATIONS

*Ann. Chem.,* vol. 729, pp. 40–51 (1969).

*29 BNA'S Patent Trademark & Copyright Journal,* pp. 35,38,49 and 50 (Nov. 15, 1984).

*Primary Examiner*—Richard L. Schilling

*Attorney, Agent, or Firm*—Sughrue, Mion, Zinn, Macpeak and Seas

[57] ABSTRACT

A heat-developable light-sensitive material comprising a support having there on a light-sensitive silver halide, a binder and a dye releasing compound which is capable of reducing the light-sensitive silver halide and reacting with the light-sensitive silver halide by heating to release a dye, said dye releasing compound is changed so as to have shorter absorption wavelength. The heat-developable light-sensitive material has high sensitivity and can be developed without supplying water from the outside.

16 Claims, No Drawings

HEAT-DEVELOPABLE LIGHT-SENSITIVE MATERIALS WITH SHIFTED DYES

FIELD OF THE INVENTION

The present invention relates to heat-developable light-sensitive materials which form dye images by heating in a state of not substantially containing water. In greater detail, the present invention relates to novel heat-developable light-sensitive materials capable of preventing reduction of sensitivity of the light-sensitive materials by coloring of the dye donative substance.

BACKGROUND OF THE INVENTION

Since a photographic process using silver halide is excellent in photographic characteristics such as sensitivity, gradation control, etc., as compared to other photographic processes such as an electrophotographic process and a diazo photographic process, the silver halide photographic process has been most widely used. Recently, however, a technique capable of easily and quickly obtaining images has been developed by performing the image formation of a light-sensitive material using silver halide by a dry treatment such as heating in place of performing the image-formation by a conventional wet treatment such as a treatment by a developing liquid, etc.

A heat developable light-sensitive material is known in the field of the art and such a heat developable light-sensitive material and a process of processing it are described in, for example, *Shashin Kogaku no Kiso* (*The Basis of Photographic Engineering*), pages 553–555, published by Korona K. K. in 1979; *EIZO JOHO* (*Image Information*), page 40, published in April 1978; *Nebletts Handbook of Photography and Reprography,* 7th Ed., pages 32–33, published by Van Nostrand Reinhold Company; U.S. Pat. Nos. 3,152,904; 3,301,678; 3,392,020 and 3,457,075; U.K. Patent Nos. 1,131,108 and 1,167,777; and *Research Disclosure,* pages 9–15 June 1978 (RD-17029).

Various processes of obtaining color images by a dry system have been proposed. For example, for a process of forming color images by the combination of the oxidation product of a developing agent and couplers, a reducing agent such as p-phenylenediamines and phenolic or active methylene couplers are disclosed in U.S. Pat. No. 3,531,286, p-aminophenolic reducing agents are disclosed in U.S. Pat. No. 3,761,270, sulfonamidophenolic reducing agents are disclosed in Belgian Patent No. 802,519 and *Research Disclosure,* pages 31–32, September 1975, and the combination of the sulfonamidophenolic reducing agents and four-equilvalent couplers is disclosed in U.S. Pat. No. 4,021,240.

However, the foregoing processes have a fault that color images formed become turbid since an image of reduced image and a color image are simultaneously formed at the exposed area of a light-sensitive material after heat development. For overcoming the fault, there is a method of removing the silver image by a liquid treatment or a method of transferring the dye only to other layer such as a sheet having an image-receiving layer. However, such a method has also a fault that it is not easy to transfer the dye only separately from unreacted materials.

Also, a method of introducing a nitrogen-containing heterocyclic group in a dye, forming a silver salt, and liberating the dye by heat development is described in *Research Disclosure,* pages 54–58, May 1978 (RD-16966). However, the method cannot form clear images since it is difficult to liberate the dye at unexposed areas and hence is not suitable for general use.

Furthermore, useful dyes and bleaching processes for forming positive dye images by a heat-sensitive silver dye bleach process are described in, for example, *Research Disclosure,* pages 30–32, April 1976 (RD-14433); ibid, pages 14–15, December 1976 (RD-15227); U.S. Pat. No. 4,235,957, etc. However, these methods have faults that additional material and step, such as an activator sheet for accelerating the bleach of the dye and a step of superposing the activator sheet and heating are required and also the color images formed by the methods cannot be stably preserved for a long period of time since the color images are gradually bleached by reduction with free silver, etc., which are co-existing.

Also, a method of forming color images utilizing leuco dyes is described in, for example, U.S. Pat. Nos. 3,985,565 and 4,022,617. However, the method has also a fault that it is difficult to stably incorporate a leuco dye in a photographic material and hence the photographic material is gradually colored during the preservation thereof.

The present inventors have proposed already novel light-sensitive materials capable of overcoming these faults in the prior processes and have proposed a method of forming images for such purposes (Japanese Patent Application No. 157758/81). It relates to heat-developable light-sensitive materials capable of releasing a movable hydrophilic dye by a simple method, namely, by heating in a state of not substantially containing water.

As a result of further studying for improving sensitivity of light-sensitive materials in such prior invention, the present inventors have found that use of colored dye releasing compound in the emulsion layer is conclusively disadvantageous because of absorption of light by the dye and that, as means for avoiding such a disadvantage, there are means wherein a layer containing a light-sensitive substance is separated from a layer containing a dye releasing compound and the layer containing a light-sensitive substance is provided on the side intended for exposure and means wherein absorption zone of the colored dye releasing compound is separated from sensitive zone of the light sensitive substance, but sensitivity of the light-sensitive materials is greatly improved by controlling the hue of the dye releasing compound to be incorporated in the light-sensitive materials. Thus, the present invention has been attained.

SUMMARY OF THE INVENTION

The first object of the present invention is to provide a heat-developable light-sensitive material having high sensitivity capable of forming dye images by heating in a state of not substantially containing water.

The second object of the present invention is to provide novel dye releasing compounds for producing a heat-developable light-sensitive material having high sensitivity.

Further, the third object of the present invention is to provide a method of improving sensitivity of heat-developable light-sensitive materials capable of forming dye images by heating in a state of not substantially containing water.

The present invention relates to a heat-developable light-sensitive material comprising a base having thereon a light-sensitive silver halide, a binder and a dye releasing compound which is capable of reducing the light-sensitive silver halide and reacting with the light-sensitive silver halide by heating to release a dye, wherein the color of said dye releasing compound is changed so as to have shorter absorption wavelengths.

DETAILED DESCRIPTION OF THE INVENTION

In light-sensitive materials according to the present invention, since an oxidation-reduction reaction is caused between the light-sensitive silver halide and the reducing dye releasing compound by means of exposed light-sensitive silver halide as a catalyst by heating in a state of not substantially containing water after imagewise exposure or simultaneously with an imagewise exposure, mobile dye images released from an oxidation product of the dye releasing compound oxidized by silver halide are formed on the exposed area simultaneously with forming silver images, but the released mobile dye images are difficult to distinguish in a state of carrying out only heat development, because the unreacted dye releasing compound is coexistent. However, in the present invention, it is possible to transfer the dye in the resulted dye images into a dye fixing layer under an atmosphere having affinity for the dye, because the dye is mobile dye, and, consequently, it is possible to obtain dye images having excellent image quality and excellent preservative property. This step is the step "dye fixing" in the present invention, by which dye images having good color reproduction can be formed.

This principle is not essentially different in each of the case of using a negative emulsion as an emulsion for the light-sensitive materials and the case of using an auto-positive emulsion. Accordingly, in case of using the auto-positive emulsion, it is possible to obtain dye images having good color reproduction by the same manner as the case of using the negative emulsion, except that only dye images in the resulted silver images and mobile dye images on the unexposed area are transferred to the dye fixing layer.

The oxidation-reduction reaction between the light-sensitive silver halide and the dye releasing compound and the subsequent dye releasing reaction can be caused by heating in a state of not substantially containing water. Here, the term "heating" means heating at 80° C.–250° C., and the term "state of not substantially contain water" means the state that water for generating or accelerating the reaction is not supplied, wherein the reaction system is in a state of equilibrium with moisture in the air. Such a state has been described in "The Theory of the Photographic Process" 4th ed. (Editted by T. H. James, Macmillan) page 374.

In the present invention, it is possible to reproduce various kinds of color, because the dye to be released can be chosen by selection of the dye releasing compound. Accordingly, multicolor formation can be carried out by selection of the combination of colors. Accordingly, the dye images of the present invention include not only monochromatic images but also multicolor images, and the monochromatic images include those formed by mixing two or more colors.

In view of the prior dye releasing reaction which is believed to be caused by attack of a nucleophilic reagent and is carried out generally in an aqueous solution having a pH of 10 or higher, it is an exceptional fact that the light-sensitive materials used in the present invention show high reactivity by only heating in a state of not substantially containing water. Further, in view of the prior knowledge obtained from wet development at a room temperature, it is also very exceptional fact that the dye releasing compounds used in the present invention are able to cause the oxidation-reduction reaction with silver halide without using the so-called auxiliary developing agent (Japanese Patent Application No. 157798/81).

The above described reactions particularly well proceed in a presence of an organic silver salt oxidizing agent, by which high image densities can be obtained. Accordingly, presence of the organic silver salt oxidizing agent is a particularly preferred embodiment.

The light absorption zone of the dye moiety to be released by heat development from the dye releasing compounds used in the present invention is changed to have shorter absorption wavelengths at least until the light-sensitive material is exposed.

Coloration of the dye releasing compounds is caused by coloration of the dye moiety of said compound, namely, the mobile dye which forms images by releasing from the dye releasing compounds, and this coloration reduces the amount of light to be effectively absorbed in the light-sensitive materials. In the present invention, the light absorption zone of the dye moiety to be released is separated from the light sensitive zone of the light-sensitive substance by changing it so as to have shorter absorption wavelengths as described above. In this case, since the dye imagewise released by the development processing should have an inherent color of the dye, the changed state of the absorption zone to shorter wavelengths is restricted to being only when the dye moiety is yet in the part of the dye releasing compound and it should not have a bad influence upon the dye after releasing. It is a temporary changing of the absorption zone to shorter absorption wavelengths.

Accordingly, in the light-sensitive materials of the present invention, it is possible to form silver images and a mobile dye on areas corresponding to the silver images at the same time by only heating after imagewise exposure or simultaneously with an imagewise exposure.

In illustrating in greater detail, in case of using a combination of a red-sensitive silver halide emulsion and a dye releasing compound which releases a cyan dye, the dye releasing compound which releases a cyan dye is designed so as to absorb light of wavelength shorter than red light when exposed to light. This dye temporarily changed to that which absorb shorter wavelengths becomes an inherent cyan dye by heating after exposure, by which dye images can be formed.

In case of using a green-sensitive silver halide emulsion, a dye releasing compound which is, for example, yellow upon exposure but becomes magenta by heating is used.

According to the method of the present invention, it is possible to incorporate the dye releasing compound and the light-sensitive substance in the same layer. Further, the layer containing the dye releasing compound may be placed on the side intended for exposure nearer than the layer containing the light-sensitive substance.

As a method for temporarily changing of the color of the substance so as to have shorter absorption wavelengths, it is most conventional to use a method which comprises protecting an electron donative group in the dye conjugated system, the so-called auxochrome (hydroxyl group or amino group, etc.) with a suitable protective group to reduce the electron donative ability of it or a method which comprises converting the dye moiety in a dye-releasing compound to a reduction type (leuco compound) (and, if necessary, protecting hydroxyl group or amino group in the leuco compound to stabilize it to oxidation). The color is reproduced by a function of the nucleophilic reagent such as a base (explained hereinafter) during heat development in the former case and by oxidation in the latter case. Examples of the former case have been described in U.S. Pat. Nos. 3,336,287, 3,579,334 and 3,999,991, etc. and those of the latter case have been described in Japanese Patent Application (OPI) No. 91324/75 and U.S. Pat. Nos. 3,880,658, 3,935,262 and 3,935,263, etc.

In the present invention, the former case is particularly available. Examples of protective groups include acyl groups (an acyl group having an alkyl group having 1–22 carbon atoms or an aryl group having 6–22 carbon atoms), unsubstituted carbamoyl groups, substituted carbamoyl groups with an alkyl or an aryl group, alkylsulfonyl groups having 1 to 22 carbon atoms, arylsulfonyl groups having 6–22 carbon atoms,

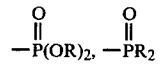

(R: alkyl group having 1–22 carbon atoms or aryl group having 6–22 carbon atoms) and trialkylsilyl groups wherein the alkyl group having 1–22 carbon atoms, etc. are available.

Preferable examples of dye-releasing compounds of which electron donative groups are protected are those represented by the following general formula (I);

$$R_a—SO_2—D—A—G \quad (I)$$

wherein $R_a$ represents a reducing group capable of being oxidized by the silver halide; and D represents an image forming dye moiety; A represents an electron donative group of which the electron donative property becomes higher than that of —A—G after releasing of G; G represents a protective group which decreases the electron donative property of A and which releases upon heating the dye releasing compound. (General formulae for preferable dye releasing compounds and examples thereof are disclosed in European Patent Application (OPI) No. 76,492).

Preferable examples of G are the same as the examples for protective groups shown hereinabove.

Preferable examples of A include groups which provides —OH, $—NHSO_2R_1$, $—NH_2$,

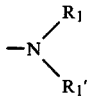

or $—NHR_1$ after releasing of G, wherein $R_1$ and $R_1'$ each represents an alkyl and an aryl group.

More preferable examples of groups A and G can be seen in examples of the dye releasing compound which are shown hereinbelow.

Examples of dyes which can be used for image forming dye include azo dyes, azomethine dyes, enthraquinone dyes, naphthoguinone dyes, styryl dyes, nitro dyes, quinoline dyes, carbonyl dyes and phthalocyanine dyes, etc. Representative examples of them are set forth below and are classified by hue.

In the present invention, two or more kinds of dye releasing compounds can be used together. They may be used for the case of forming the same color or may be used for the case of forming another color, for example, the case of forming black by using three or more of them. In the present invention a dye releasing compound which releases a hydrophilic dye is preferable.

The amount of the dye releasing compound used in the present invention is preferred in a range of 10 $mg/m^2$ to 15 $g/m^2$ as a total, and, preferably 20 $mg/m^2$ to 10 $g/m^2$.

In the following, examples of the dye releasing compounds which are temporarily changed so as to have a color which absorbs shorter wavelengths used in the present invention are described, but the present invention is not limited to them. In the following examples colors of compounds (1), (2), (3), (7), (10), (12), (14), (15) are yellow and these compounds provide cyan dyes. The colors of compounds (4), (5), (6), (8), (9), (11), (13) and (16) are yellow and these compounds provide magenta dyes.

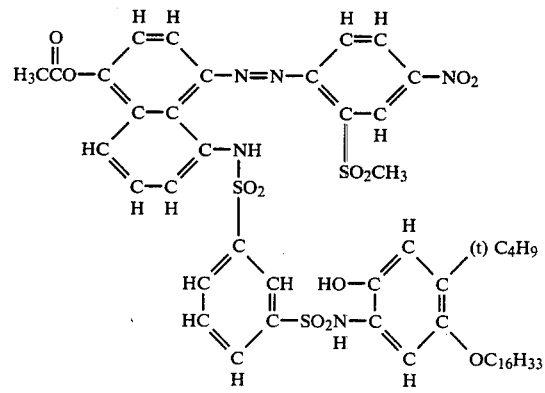

(1)

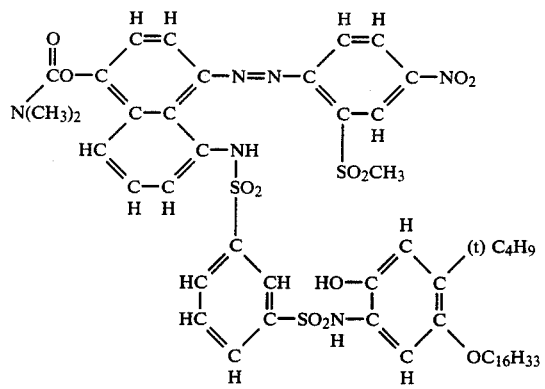

(2)

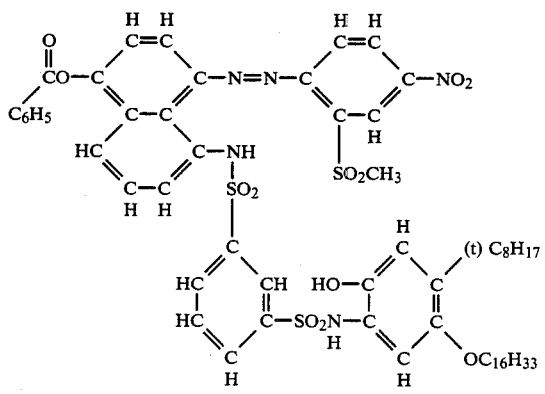

(3)

-continued
(4)
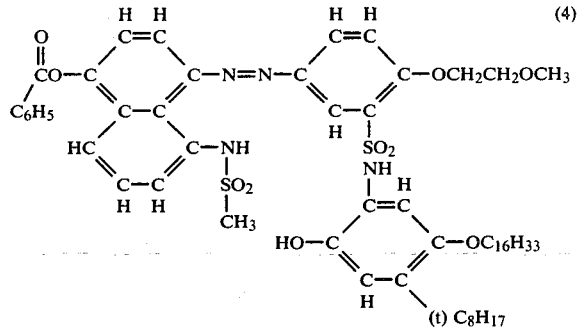
(5)
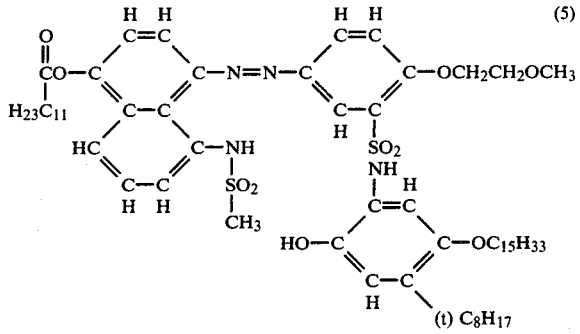
(6)
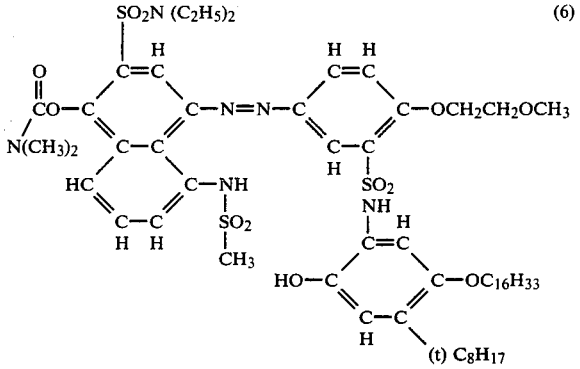
(7)
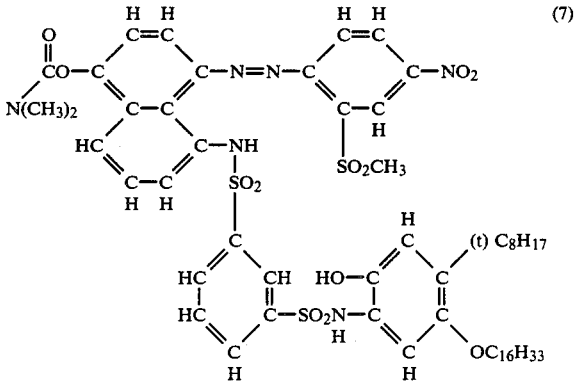
-continued
(8)
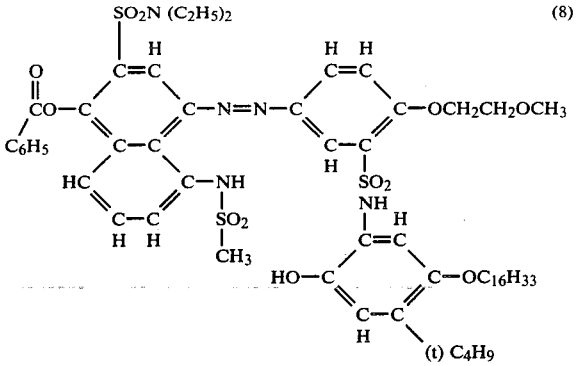
(9)
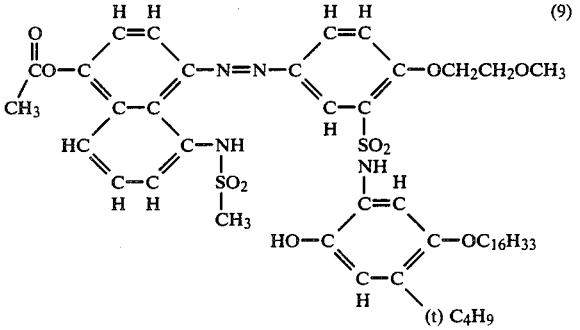
(10)
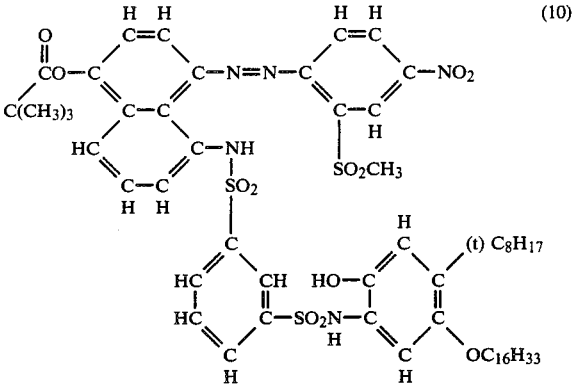
(11)
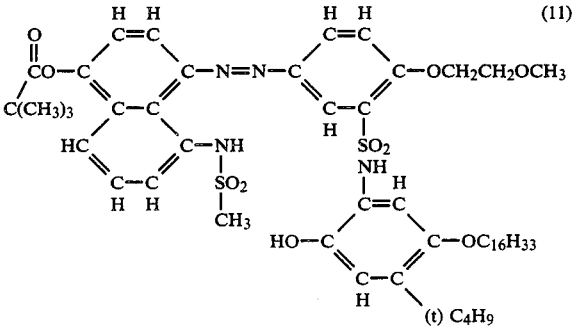

-continued (12)

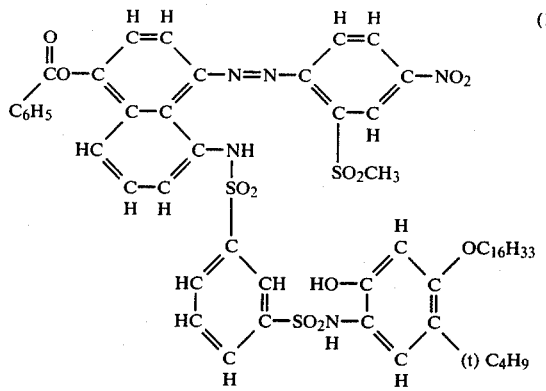

(13)

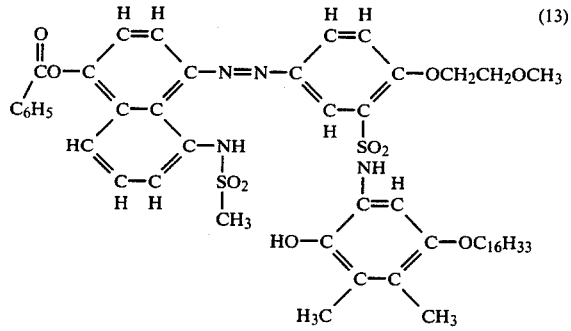

(14)

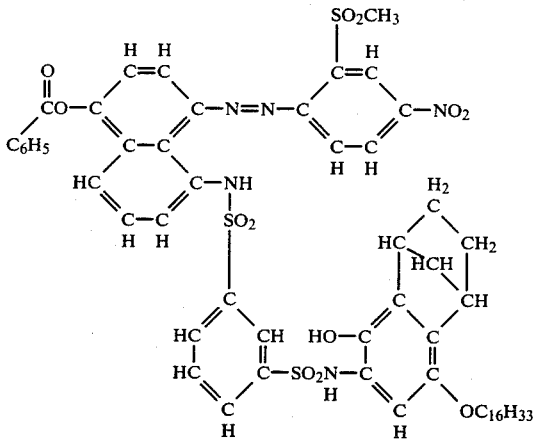

(15)

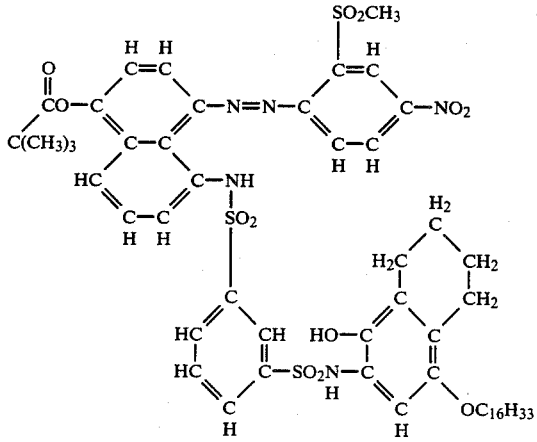

-continued (16)

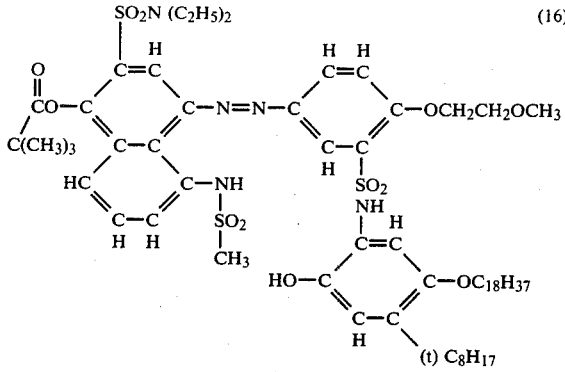

In the following, examples of synthesizing the above described dye releasing compounds which are temporarily changed so as to have a color of shorter wavelengths are described. The dye releasing compounds which are changed so as to have a color of shorter wavelengths used in the present invention are synthesized generally by reacting a dye releasing compound having an inherent color with an acylating agent, etc. to introduce a protective group. In this case, it is important that the reaction is carried out under a suitable condition that hydroxyl groups in the reducible substratum in the dye releasing compound are not protected. It is further preferred to previously protect hydroxyl groups in the reducible substratum with other protective groups capable of releasing by heat development. In the following synthesis examples are shown.

SYNTHESIS EXAMPLE 1

Synthesis of dye releasing compound which is changed so as to have a color of shorter absorption wavelengths (1)

10 g of the following dye releasing compound (1-a) was dissolved in a mixture composed of 30 ml of dimethylformamide and 5 ml of pyridine. 2 ml of acetic acid anhydride was added dropwise to the solution with cooling by ice. After addition, the solution was stirred at 5°-10° C. for 30 minutes, and thereafter the reaction solution was poured in 100 ml of cold diluted hydrochloric acid.

The formed reddish brown precipitate was filtered off, washed with water and dried, and thereafter it was purified by silica gel chromatography (elute:ethyl acetate/hexane: 1/1 by volume) to obtain 6.5 g of the dye releasing compound which was changed so as to have a color of shorter wavelengths.

m.p. was 155°-161° C.

Dye releasing compound (1-a):

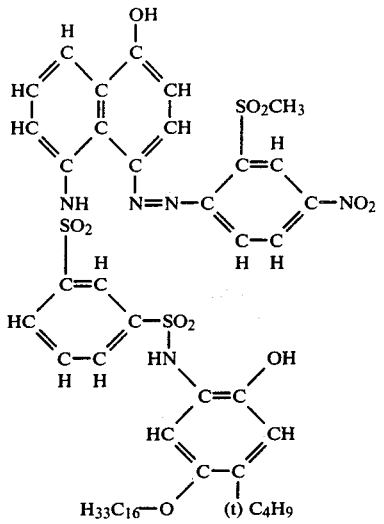

SYNTHESIS EXAMPLE 2

Synthesis of dye releasing compound which is changed so as to have a color of shorter wavelengths (3)

10.5 g of the following dye releasing compound (3-a) was dissolved in a mixture composed of 30 ml of dimethylformamide, 5 ml of pyridine and 10 ml of acetonitrile. Then, 2.1 g of benzoyl chloride was added to the solution with cooling by ice. After stirred at 0°-5° C. for 10 minutes, the reaction solution was poured in cold diluted hydrochloric acid. The separated brown oil was extracted with ethyl acetate. After concentrated, it was purified by silica gel chromatography (elute: ethyl acetate/hexane: ½ by volume) to obtain 4.8 g of the yellowish brown dye releasing compound which was changed so as to have a hue of shorter wavelengths. m.p. was 151°-157° C.

Dye releasing compound (3-a):

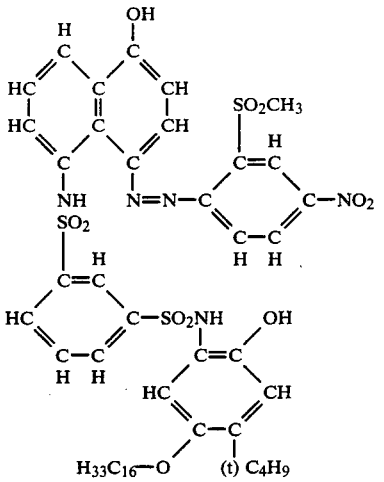

The dye releasing compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No 39853/76 and Japanese Patent Application (OPI) No. 39943/76. Moreover, various surface active agents can be used when the dye releasing redox compound is dispersed in a hydrophilic colloid. For this purpose, the surface active agents illustrated in other part of the specification can be used.

In the present invention an organic solvent having a high boiling point may be used in an amount of not more than 10 g, preferably of not more than 5 g per gram of a dye releasing compound.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its grain. That is, the silver halide which shows the X-ray diffraction pattern of pure silver iodide is particularly preferred.

In photographic materials a silver halide containing two or more kinds of halogen atoms can be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above-described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver salt of an organic compound having a carboxy group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole of 1-H-tetrazole as described in U.S. Pat. No. 4,220,709,a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

In the present invention, if necessary, a reducing agent may be used. The reducing agent in this case is the so-called auxiliary developing agent, which is oxidized by the silver halide and/or the organic silver salt oxidizing agent to form its oxidized product having an ability to oxidize the reducing group in the dye releasing compound.

Examples of useful auxiliary developing agent include the compounds specifically described in European Patent Application (OPI) No. 76,492.

The auxiliary developing agent may be used in an amount of 0.0005 to 20 moles, preferably, 0.001 to 4 moles per mole of silver.

The heat development mechanism of this invention during heating has not yet sufficiently been clariifed but can be considered to be as follows.

When the light-sensitive material is imagewise exposed to light, a latent image is formed on the light-sensitive silver halide. This is described in T. H. James, *The Theory of the Photographic Process,* 3rd Edition, pages 105–148.

By heating the light-sensitive material of the dye-releasing compound acts as a reducing agent to reduce a silver halide and/or an organic silver salt to produce silver in the presence of latent image nuclei as a catalyst. The dye-releasing compound is oxidized and cleaves to release a dye. In this case, the release reaction of dye is promoted when a nucleophilic reagent exists in the system. In the case of using an organic silver salt oxidizing agent together, it is necessary the silver halide and the organic silver salt oxidizing agent are disposed in a substantially effective distance for quickly initiating the reaction. Thus, it is desired that the silver halide and the organic silver halide oxidizing agent are in a same layer of a photographic element.

In the development by heating, it takes a long time to finish the reaction since the diffusion of reaction molecules is restricted in the heat development different from a so-called wet development. However, if heating for development is performed for a too long time, the heat reaction at the unexposed areas cannot be disregarded and so-called fog undesirably forms.

In this invention, a thermal solvent can be used as a means for overcoming such a difficulty.

The term "thermal solvent" means a non-hydrolyzable organic material which melts at a temperature of heat treatment and melts at a lower temperature of heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuceli, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocyanine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. No. 3,743,510), cadmium salts, azaindene compounds, etc., can be present. The combinations described in U.S. Pat. Nos. 3,615,613, 3,615,641, 3,617,295 and 3,635,721 are particularly useful.

In the present invention, various kinds of dye releasing activators can be used. The dye releasing activator means a substance which accelerates the oxidation-reduction reaction between the light-sensitive silver halide and/or the organic silver salt oxidizing agent and dye releasing redox compound, or accelerates release of a dye by means of its nucleophilic action to the oxidized dye releasing redox compound in the dye releasing reaction subsequently occurred, and a base and a base precursor can be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444 are useful. The base precursor is a substance which releases a basic component by heating. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color photographic material in order to accelerate development and accelerate release of a dye.

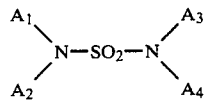

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

The above-described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

A support used in the light-sensitive material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyl-taurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts* (edited by Schoufeldt N. Pergamon Press, 1969). Among the nonionic surface active agents described in the above-mentioned references, those capable of satisfying the above-described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

Further in the present invention, it is possible to use a compound which activates development and stabilizes the image at the same time. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)-methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

Examples of various additives include those described in *Research Disclosure,* Vol. 170, No. 17029 (June 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Patent No. 837,095.

Various means for exposure can be used in the present invention. Latent images are obtained by image-wise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereto may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, if necessary, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive layer.

Further, there is a method wherein only the light-sensitive layer (I) is exposed imagewise to light and heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

When the dye mordant is a polymer mordant, the polymer mordant functions as a binder and hence in this case, the amount of a binder may be reduced or a binder may be omitted. On the contrary, when a binder has a function as a mordant, a dye mordant may not be used. Examples of the binder, include same materials as used for light-sensitive materials.

The mordant used for the dye-fixing layer in this invention can be properly selected from the mordants usually used and among these materials, polymer mordants are particularly preferred.

Polymer mordants used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridinium-propionyl groups, vinylcarbonyl groups, alkylsulfonoxy groups, etc.), such as

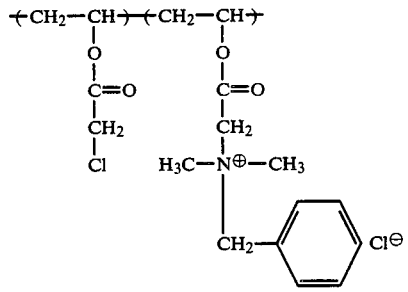

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

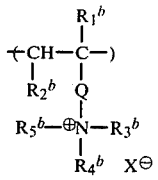

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded together to form a hetero ring, and X represents an anion such as a halogen ion and sulfonyl ion. The above described alkyl groups and aryl groups may be substituted.

(3) Polymers represented by the following general formula

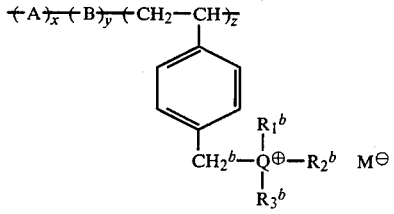

wherein x is from about 0.25 mol% to about 5 mol%, y is from about 0 mol% to about 90 mol%, z is from about 10 mol% to about 99 mol%, A represents a repeating unit derived from a monomer having at least two ethylenically unsaturated bonds, B represents a repeating unit derived from a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and M represents an anion such as a halogen ion and sulfonyl ion.

(4) Copolymers composed of (a), (b) and (c), wherein (a) is

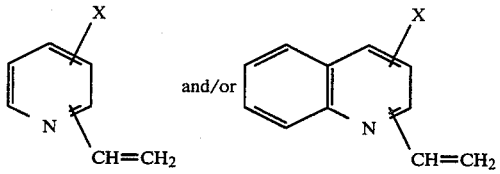

wherein X represents a hydrogen atom, an alkyl group or a halogen atom (the alkyl group may be substituted);

(b) is an acrylic ester; and (c) is acrylonitrile.

(5) Water-insoluble polymers wherein at least ⅓ of the repeating units are those represented by the following general formula

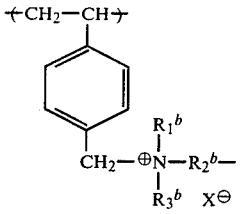

wherein $R_1^b$, $R_2^b$ and $R_3^b$ each represents an alkyl group, with the total number of carbon atoms included being 12 or more (the alkyl group may be substituted), and X represents an anion such as a halogen ion and a sulfonyl ion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from 20/80 to 80/20 (by weight) and the amount of the mordant coated is from 0.5 to 8 g/m$^2$.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant.

In the process in which the dye transfer assistants are supplied from the outside, water and an aqueous solution containing sodium hydroxide, potassium hydroxide or an inorganic alkali metal salt can be used. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be applied by wetting the dye fixing layer with the transfer assistant.

When the dye transfer assistant is incorporated into the light-sensitive material or the dye fixing material, it is not necessary to supply the transfer assistant from the outside. In this case, the above-described dye transfer assistant may be incorporated into the material in the form of water of crystallization or microcapsules or as a precursor which releases a solvent at a high temperature.

More preferred process is a process wherein a hydrophilic thermal solvent which is solid at a lower temperature and melts at a higher temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

When the dye-fixing layer is disposed at the surface of the dye-fixing material, a protective layer may further formed on the layer. As such a protective layer, a material ordinary used for protective layers for ordinary light-sensitive materials can be used as it is but when the dye-fixing layer is formed on the dye-fixing material separately from the light-sensitive material, it is preferred to render the protective layer hydrophilic for not hindering the transfer of a hydrophilic dye into the dye-fixing layer.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

As a heating means for transferring a dye from a light-sensitive layer to a dye fixing layer the means which can be used for heat development described hereinbefore can also be used.

Since the absorption wavelengths of the dye moiety of the dye releasing compound in the present invention is changed to shorter absorption wavelengths for temporarily, the absorption wavelength range of the dye releasing compound is separated from that of the light-sensitive substance. This results in increasing of the sensitivity of the light-sensitive material. Furthermore, since the light having a wavelength within the range of the light-sensitive wavelengths of the light sensitive substance is not absorbed by the dye releasing compound, the dye releasing compound and the light-sensitive substance may be incorporated in a same layer, or the layer containing the dye releasing compound may be provided on the side intended to exposure nearer than the lightsensitive layer. Therefore, manufacturing conditions for the light-sensitive material can be widely changed.

The light-sensitive material of the present invention can be processed in a dry system without supplying a solvent in the whole steps from image exposure to the dye fixing. According to the present invention various heat developable light-sensitive material can be used.

The image-forming process of this invention having the foregoing features can be used not only for photographic field but also for the transfer of so-called soft image into a hard image. Moreover, since the dye image formed is fixed in a dye-fixing layer, the image has good preservative stability and the process of this invention can be easily utilized in the case of requiring the preservation of dye images for a long period of time. Thus, the invention exceed conventional photographic techniques and hence the significance of this invention is large.

Then, the invention will further be explained by the following examples but the invention shall not be restricted by these examples. (% in Examples is shown based on weight).

EXAMPLE 1

Preparation of silver iodobromide emulsion:

In 3,000 ml of water were dissolved 40 g of gelatin and 26 g of potassium bromide and after stirring the solution at 50° C., a solution of 34 g of silver nitrate dissolved in 200 ml of water was added to the solution over a period of 10 minutes. Then, a solution of 3.3 g of potassium iodide dissolved in 100 ml of water was added to the mixture over a period of 2 minutes.

Then, the pH of the silver iodobromide emulsion thus formed was adjusted to sediment the emulsion and after removing excessive salts, the pH of the emulsion was adjusted to 6.0 to provide 400 g of a silver iodobromide emulsion.

Preparation of dispersion of reducible dye-releasing compound:

To a mixture of 5 g of the dye-releasing compound (3), 0.5 g of succinic acid 2-ethylhexyl ester sodium sulfonate, and 15 g of tricresyl phosphate (TCP) was added 30 ml of ethylacetate, and the components were dissolved by heating to 60° C. After mixing the solution with 100 g of a 10 wt% aqueous solution of gelatin followed by stirring, the mixture was dispersed for 10 minutes by a homogenizer at 10,000 r.p.m. to provide a dispersion of the dye-releasing compound (3).

Then, the preparation method for a light-sensitive material A is explained.

(a) Light-sensitive silver iodobromide emulsion: 25 g
(b) 0.1% Methanol solution of compound P: 2.5 ml
(c) Dispersion of dye-releasing compound (3): 33 g
(d) 5 wt% Aqueous solution of the compound of the formula: 5 ml

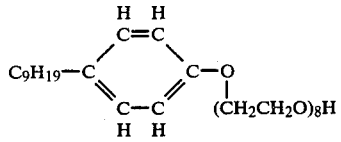

(e) 10 wt% Ethanol solution of guanidine trichloroacetate: 12 ml
(f) 10 wt% Aqueous solution of dimethylsulfonamide: 4 ml
(g) Water: 8 ml Components (a) to (g) were mixed and dissolved. The solution was coated on a polyethylene terephthalate film at a wet thickness of 30 μm and dried.

Furthermore, a coating liquid having the following composition was coated on the layer to provide a protective layer having a wet thickness of 25 μm and dried to obtain a light-sensitive material A.

(h) 10 wt% Aqueous solution of gelatin: 35 g
(i) 10 wt% Ethanol solution of guanidine trichloroacetate: 5 ml
(j) 1 wt% Aqueous solution of succinic acid 2-ethylhexyl ester-sodium sulfonate: 4 ml
(k) Water: 56 ml Then, as a comparative sample, light-sensitive material B was produced by carrying out the same procedure as described above, except that the compound ($Q^1$) shown hereinbelow was used instead of the dye releasing compound (3) of the present invention.

Compound (P)

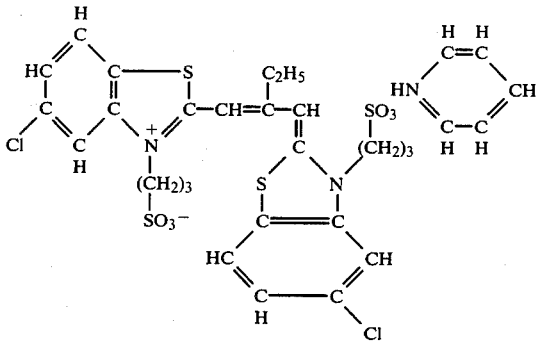

Compound ($Q^1$)

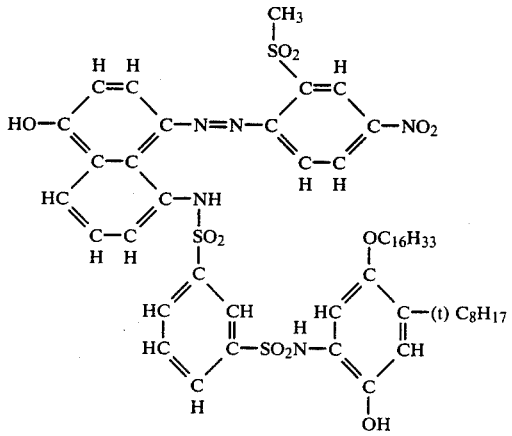

Preparation of dye-fixing material:

In 200 ml of water was dissolved 10 g of methyl acrylate-N,N,N-trimethyl-N-vinylbenzylammonium chloride copolymer (the molar ratio of methyl acrylate and vinylbenzylammonium chloride being 1:1) and the solution was uniformly mixed with 100 g of a 10 wt% solution of limed gelatin. The mixture was uniformly coated on a paper support laminated with a polyethylene film having dispersed therein titanium oxide, at a wet thickness of 90 μm. After drying the sample a dye-fixing layer having a mordant layer was obtained.

The light sensitive material B was imagewise exposed through a red filter for 10 seconds at 2,000 luxes using a tungsten lamp and then uniformly heated on a heat block heated to 130° C., for 20 seconds.

Then, the above described dye fixing material was immersed in water, and the above described light-sensitive material B after conclusion of heat treatment was placed so that the film face thereof was brought into contact with the film face of the wet dye fixing material. Thereafter, they were heated on a heat block at 80° C. for 6 seconds, and the dye fixing material was separated from the light-sensitive material, by which negative cyan dye images were formed on the dye fixing material.

When the light-sensitive material A containing the dye releasing substance of the present invention was subjected to processing by the same procedure as described above, clear cyan images were obtained, by which it was understood that the dye releasing substance (3) of the present invention gives inherent cyan images by the above described processing.

When the exposure time for the light-sensitive material A was varied, nearly the same result as that obtained in case of the light-sensitive material B was obtained at 2,000 luxes for only 1 second. It was understood from this result that light-sensitive materials having high sensitivity are obtained using the dye releasing compound of the present invention.

EXAMPLE 2

The preparation method for a silver benzotriazole emulsion is described.

28 g of gelatin and 13.2 g of benzotriazole were dissolved in 3,000 ml of water. The resulted solution was stirred with keeping at 40° C. To the solution, a solution prepared by dissolving 17 g of silver nitrate in 100 ml of water was added over 2 minutes.

The pH of the resulted silver benzotriazole emulsion was controlled to cause precipitation, and excess salts were removed. Then, the pH was adjusted to 6.0 to obtain a silver benzotriazole emulsion in a yield of 400 g.

In the following, the method for preparing light-sensitive material C is described.

(a) Silver benzotriazole emulsion: 10 g
(b) 0.1% methanol solution of compound (P) used in Example 1: 2.5 ml
(c) Silver iodobromide emulsion (prepared in Example 1): 20 g
(d) Dispersion of dye releasing substance (3) (prepared in Example 1): 33 g
(e) 5% aqueous solution of the compound: 5 ml

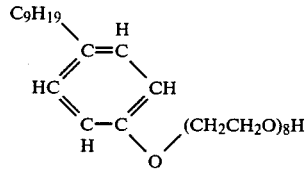

(f) 10% solution of guanidine trichloroacetic acid: 12.5 ml
(g) 10% aqueous solution of dimethylsulfamide: 4 ml
(h) Water: 7.5 ml After the above described components were mixed and dissolved, the mixture was applied to a polyethylene terephthalate film in a wet film thickness of 30 μm, followed by drying. A protective layer was applied by the same manner as in the light-sensitive material A in Example 1.

As a comparative material, light-sensitive material D was produced by the same procedure as in light-sensitive material C, except that the comparative dye releasing compound in Example 1 was used.

Light-sensitive materials C and D were processed by the same procedure as in Example 1. Clear cyan images were obtained in the case of using the light-sensitive material C. Further, nearly the same result as that obtained in light-sensitive material D (for comparison) by exposing to light at 2,000 luxes for 10 seconds was obtained in light-sensitive material C by exposing to light only for about 1 second. It was understood from this result that sensitivity of about 10 times higher is obtained when the dye releasing compound of the present invention is used.

EXAMPLE 3

Light-sensitive materials E and F (for comparison) were produced by the same procedure as in Example 2, except that dye releasing compound (1) of the present invention and compound ($Q^2$) for comparison shown herein were used, respectively.

Light-sensitive materials E and F were processed by the same procedure as in Example 2, it was understood that the light-sensitive material E containing the dye releasing compound of the present invention have a sensitivity of about 10 times higher than that of the light-sensitive material F.

Compound ($Q^2$)

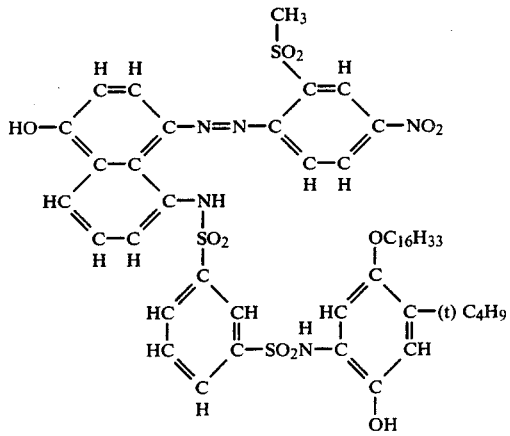

What is claimed is:

1. A heat-developable light-sensitive material comprising a support having thereon a light-sensitive silver halide, a binder and a dye releasing compound which is capable of reducing the light-sensitive silver halide and reacting with the light-sensitive silver halide by heating to release a dye;

wherein said dye-releasing compound is changed so as to have shorter absorption wavelength than that of the dye at least until the light sensitive material is subjected to exposure; and wherein the light-sensitive material contains a compound represented by the general formula (A) in order to accelerate development and accelerate release of a dye,

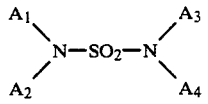

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_2$ or $A_3$ and $A_4$ may combine with each other to form a ring.

2. A heat-developable light-sensitive material as claimed in claim 1, wherein said dye-releasing compound is changed so as to have a shorter absorption wavelengths by protecting the electron donative group in the dye conjugated system in the dye-releasing substance to reduce electron donative ability of the group.

3. A heat-developable light-sensitive material as claimed in claim 2, wherein the electron donative group is protected by a group selected from the group consisting of an acryl group, a substituted carbamoyl group, an unsubstituted carbamoyl group, an alkylsulfonyl group, an arylsulfonyl group,

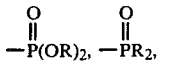

(wherein R represents an alkyl group and an aryl group) and trialkylsilyl group.

4. A heat-developable light-sensitive material as claimed in claim 1, wherein said dye-releasing compound is changed so as to have shorter absorption wavelengths by converting the dye moiety in the dye-releasing compound to a reduction type.

5. A heat-developable light-sensitive material as claimed in claim 1, wherein said dye-releasing substance is incorporated in the material in an amount of 10 $mg/m^2$ to 15 $g/m^2$.

6. A heat-developable light-sensitive material as claimed in claim 1, wherein the light-sensitive material contains an organic silver salt oxidizing agent.

7. A heat-developable light-sensitive material as claimed in claim 1, wherein the light-sensitive material contains a thermal solvent which is able to melt at a temperature of a heat treatment of the light sensitive material.

8. A heat-developable light-sensitive material as claimed in claim 1, wherein the light-sensitive material contains at least one of an amine and an amine precursor as a dye releasing activator.

9. A heat-developable light-sensitive material as claimed in claim 8, wherein said at least one of amine and an amine precursor is contained in an amount up to 50 wt% based on the amount of a dry layer coated of the light-sensitive material.

10. A heat-developable light-sensitive material as claimed in claim 1, wherein said compound represented by the general Formula (A) is incorporated in an amount of up to 20 wt% based on the amount of a dry layer coated on the light-sensitive material.

11. A heat-developable light-sensitive material as claimed in claim 10, wherein said compounds represented by the general Formula (A) is incorporated in a range of 0.1 wt% to 15 wt%.

12. A heat-developable light-sensitive material as claimed in claim 1, wherein said dye releasing compound is represented by the general formula (I);

$$R_a—SO_2—D—A—G \quad (I)$$

wherein $R_a$ represents a reducing group capable of being oxidized by the silver halide; and D represents an image forming dye moiety; A represents an electron donative group of which the electron donative property becomes higher than that of —A—G after releasing of G; G represents a protective group which decreases the electron donative property of A and which releases upon heating of the dye releasing compound.

13. A method for forming an image, which comprises imagewise exposing and heating a heat-developable light-sensitive material comprising a support having thereon a light-sensitive silver halide, a binder and a dye releasing compound which is capable of reducing the light-sensitive silver halide and reacting with the light-sensitive silver halide by heating to release a dye;

wherein said dye releasing compound is changed so as to have shorter absorption wavelengths; and wherein said light-sensitive material contains a compound represented by the general formula (A) in order to accelerate development and accelerate release of a dye,

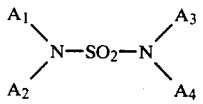

(A)

wherein $A_1$, $A_2$, $A_3$, and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_2$ or $A_3$ and $A_4$ may combine with each other to form a ring.

14. A heat-developable light-sensitive material as claimed in claim 12, wherein A represents a group which provides —OH, $—NHSO_2R_1$, $—NH_2$, $—N(R_1)R_1'$ or $—NHR_1$ after releasing G, wherein $R_1$ and $R_1'$ each represent an alkyl or an aryl group.

15. A method as claimed in claim 13, wherein said compound represented by the general Formula (A) is incorporated in an amount of up to 20 wt% based on the amount of a dry layer coated on a light-sensitive material.

16. A method as claimed in claim 15, wherein said compound represented by the general formula (A) as incorporated in a range of 0.1 wt% to 15 wt%.

* * * * *